US005161745A

United States Patent [19]

Valeri et al.

[11] Patent Number: 5,161,745

[45] Date of Patent: Nov. 10, 1992

[54] DISCHARGE APPARATUS FOR A MEDIA GRINDING MILL

[75] Inventors: William J. Valeri; Richard M. Radovich; Boris M. Babich, all of Hibbing, Minn.

[73] Assignee: Illinois Tool Works Inc., Glenview, Ill.

[21] Appl. No.: 579,472

[22] Filed: Sep. 10, 1990

[51] Int. Cl.[5] ..... B02C 17/18

[52] U.S. Cl. ..... 241/171; 241/299; 241/DIG. 30

[58] Field of Search ..... 241/80, 97, 182, 183, 241/171, 172, 299, 72, DIG. 30

[56] References Cited

U.S. PATENT DOCUMENTS 4,172,560 10/1979 Butler ..... 241/171
4,334,626 6/1982 Butler ..... 241/171
4,365,763 12/1982 Guerguerian ..... 241/171 X

*Primary Examiner*—Mark Rosenbaum
*Attorney, Agent, or Firm*—Schwartz & Weinrieb

[57] ABSTRACT

A grinding mill dishcarge apparatus cone is a multi-component arrangement with an outer segment having a coated rigid frame, an inner segment with a coated rigid frame, which inner segment has a wear plate of a high abrasion-resistant metal mountable upon the inner segment for ease of removal and replacement, and the outer segment being removable for rebuilding after extended wear and previous replacement of the inner segment.

20 Claims, 3 Drawing Sheets

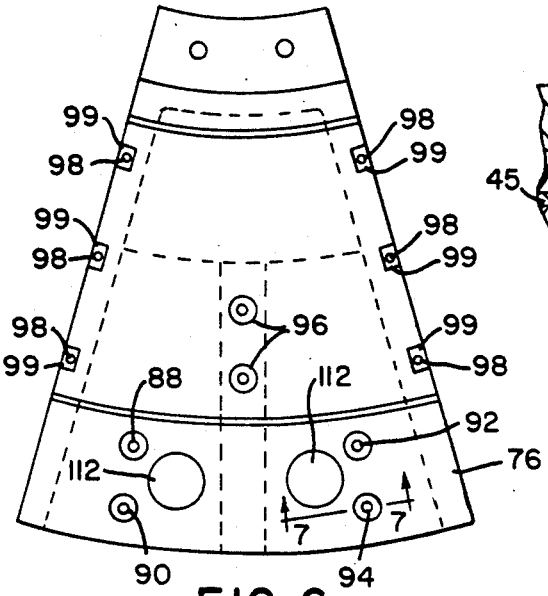
FIG. 6
FIG. 7
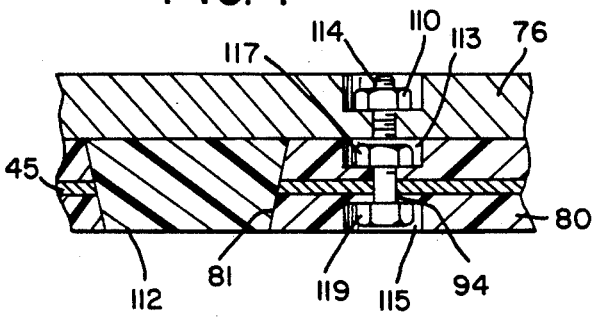
FIG. 8
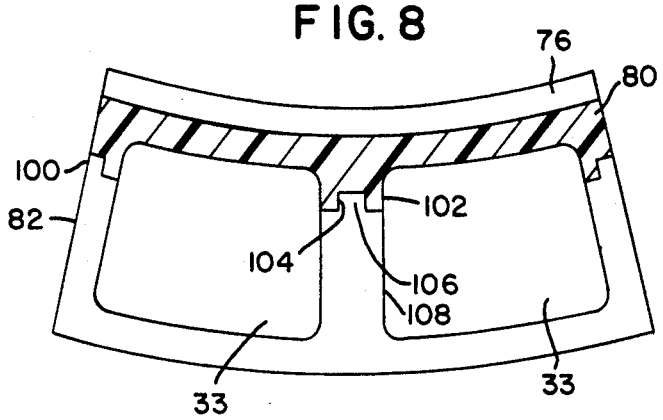
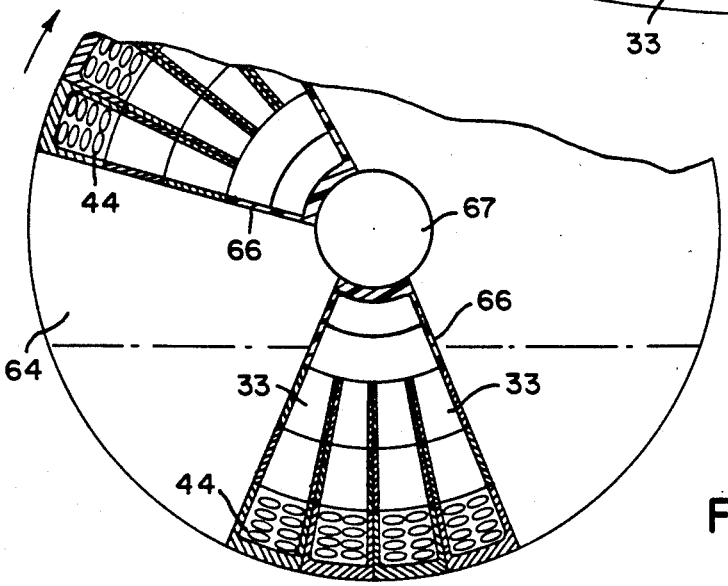
FIG. 9

DISCHARGE APPARATUS FOR A MEDIA GRINDING MILL

FIELD OF THE INVENTION

The present invention relates to grinding mills for generally granular media. More specifically the invention provides a discharge cone for an autogenous mill which utilizes a support plate for abrasive wear at the interface of the media and the cone inner surface in order to extend the life of the inner surface, and the cone itself, and to ease replacement of the plate as well.

BACKGROUND OF THE INVENTION

Grinding mills find application in ore processing and agglomeration processes, such as, for example, sintering, briquetting, and pelletizing. The mills may be bar mills, ball mills, semi-autogenous, or autogenous mills, that is a mill wherein the raw or feed material is the grinding media. The grinding apparatus may consist of a drum, an elongated cylinder, a barrel or other enclosure for retaining the raw material during the grinding cycle, as well as input devices to feed the raw material and output devices to separate, handle or otherwise distribute the ground material. A specific example of such a mill is an autogenous mill, which has a cylindrical drum and which is rotatable so as to tumble the raw material on itself for grinding the raw material to a finer mesh size. A feed chute allows for continual input to the drum through means of a port at one end of the drum, and a trommel screen arrangement at the opposite end of the drum is provided to screen the fine material and to recycle the oversize materials for further reduction in size.

The transfer of raw material to the trommel screen may be accommodated by means of an overflow or weir-like operation by as a result of the continual input of raw material thus forcing other material out the second end of the drum. However, this type of ground material transfer is not very efficient as it is not size selective and does not accommodate for a predetermined residence time within the grinding drum material above a predetermined size. Therefore, discharge apparatus are utilized to selectively cull material from the grinding stock and transfer it to the trommel screen for segregation of a finished size material and for recharging screened oversize material to the drum for further grinding. These grinding, charging and screening functions are utilized within ore processing facilities such as, for example, in the preparation of taconite ores for grinding, beneficiation and agglomeration into pellets for smelting, foundry and blast furnace operations.

The apparatus for transferring the ground material to the trommel screen is a pulp discharge vein or chute, which includes a coarse sieve-like grate operatively associated with the drum shell so as to capture some of the ground material smaller than the grate hole size for transfer through the chute to the trommel screen during the rotation of the drum, transfer chutes and trommel screen. The transfer chutes generally extend from the discharge end opening to the drum inside diameter and appear as rays or radii generally extending from the center of a circle to the circumference thereof. The chutes or veins are open at the discharge port to the trommel screen or other means, and as the drum rotates through its cycle the material gathered at the grate of each chute is gravity-fed to the chute opening for discharge to the screen. In an exemplary apparatus, the chute open ends are arranged as an annulus so as to provide a return tube port at the center of the discharge annulus for a tube returning the coarse material to the drum for further grinding.

The ore bed or raw material within the drum is generally below the level of the discharge port and had previously been at a depth that was positioned along the discharge chute length, which discharge tubes were fabricated from a wearable metal so as to avoid the abrasion from the ores. However, in an effort to increase production and utilization of plant and equipment the users have increased the bed depth within the drum and established the bed/air interface at the rear surface of the discharge cone of the chute. The discharge cone length was previously a one-piece design with a polyurethane coating which survived processing of 8.0 million tons, as the bed level did not impinge upon its surface. However, the increased height of the bed provided abrasive interference at the mill or outer side of the discharge cone, which caused premature cone erosion at approximately 4.0 million tons of processed ore. Makeshift metal wear plates are presently bolted onto the cones utilizing the cone mounting bolts securing the cone to the drum end plate, which again raises the cone wear life to 8.0 million tons. The replacement of these metal wear plates is, however, time-consuming since the bolts are commonly shared with the discharge cone.

Another attempt to extend the cone life utilized thicker wear plates embedded within the polyurethane casting. This approach fell short of the 8.0 million ton target and metal wear plates were again required to be bolted to the cone.

This extensive wear plate replacement procedure and discharge cone replacement at 8.0 million tons has prompted research into means for extending the service life of the cone wearing components and making the high wear components easier to replace so as to reduce mill down time.

SUMMARY OF THE INVENTION

The present invention provides a discharge chute for a grinding mill, and more specifically a multiple component cone for the discharge chute or vein. The discharge cone has a wearing interface with the upper surface of the ore bed and is subject to intermittent contact with the ore bed at this interface, which leads to abrasion and erosion of the one-bed contact surface. The present invention provides an easily removable and replaceable wear plate at this interface region, an easily replaceable high-wear section of the cone and further provides alternate materials for the different regions of the cone to accommodate varying physical and chemical property conditions of the chute and its environment, which overcomes these problems and extends the life of the chute so as to thus improve the productivity of the grinding mill by limiting the required and scheduled amount of maintenance and downtime.

BRIEF DESCRIPTION OF THE DRAWINGS

Various other objects, features, and attendant advantages of the present invention will become better understood from the following detailed description, when considered in connection with the accompanying drawings, in which like reference characters designate like or corresponding parts throughout the several views, and wherein:

FIG. 6 is a plan view of the discharge chute of FIG. 5;

FIG. 7 is an enlarged cross-sectional view of the bolt arrangement along the line 7—7 in FIG. 6;

FIG. 8 is a feed end view in cross-section of the cone in FIG. 5 taken along section line 8—8; and, FIG. 9 is a plan view of the drum end with several of the discharge chutes.

DETAILED DESCRIPTION OF THE INVENTION

Figure 1:
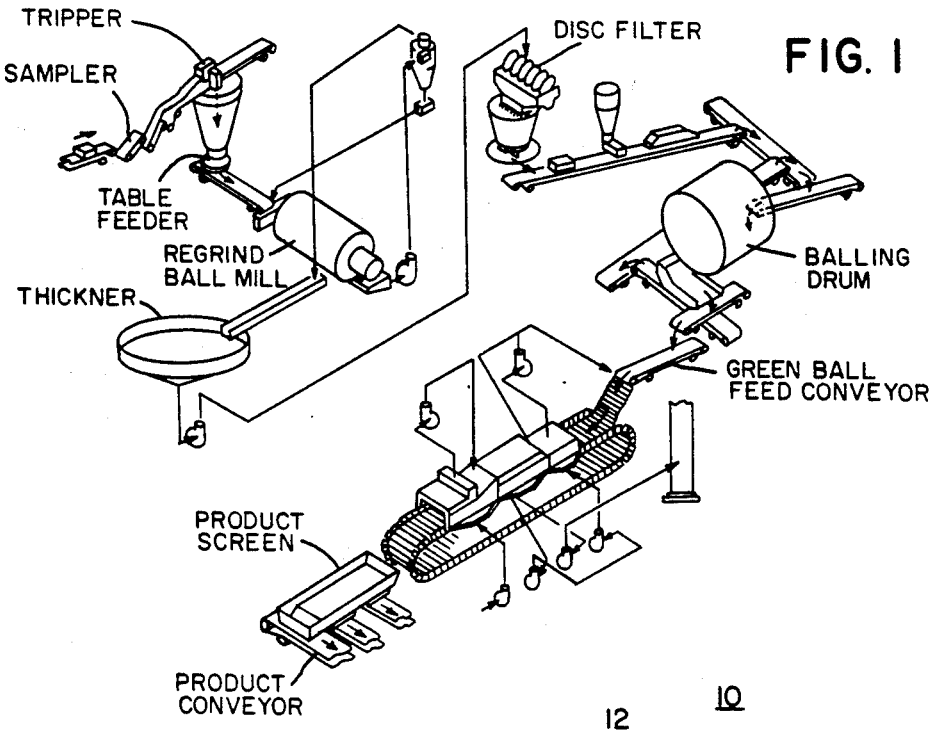
FIG. 1 is a diagrammatic illustration of a grinding and balling process.
Figure 2:
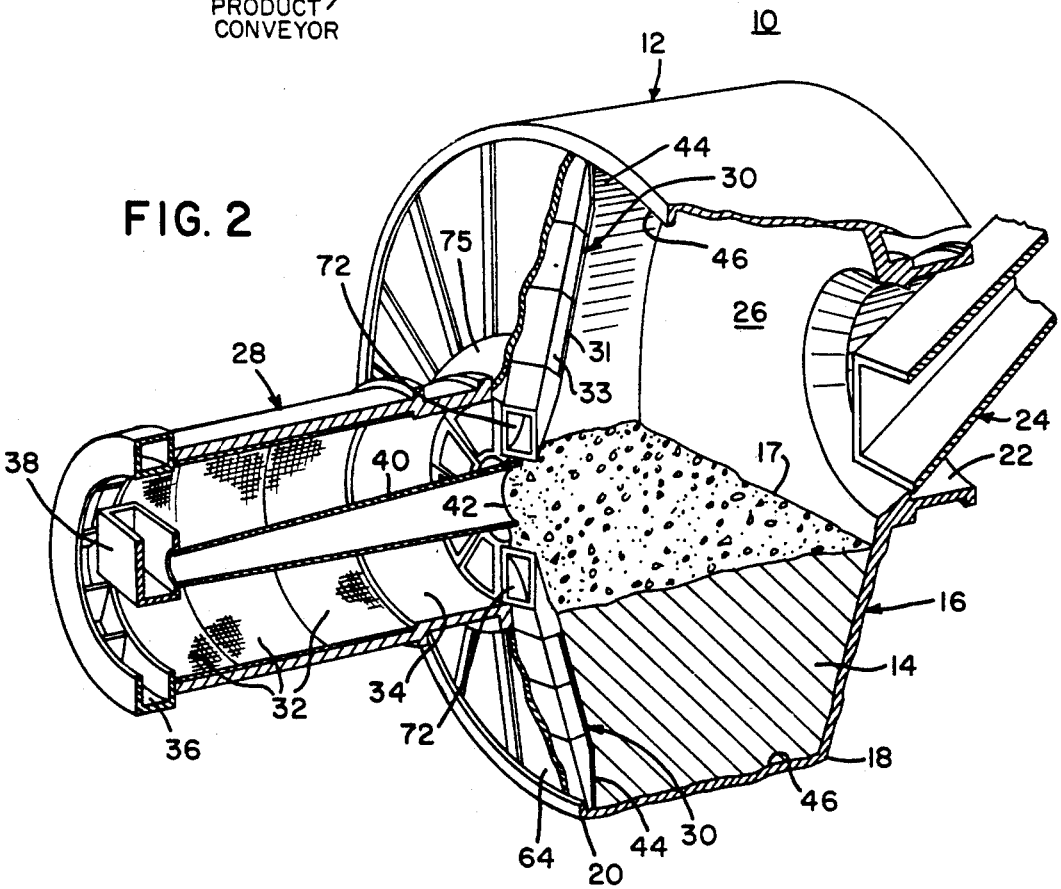
FIG. 2 is a perspective view in partial cross-section of a rotary grinding mill.

Grinding mills 10 in FIGS. 1 and 2 are utilized in agglomeration operations, such as, for example, sintering and pelletizing, to grind raw material constituents to a more uniform size for subsequent leaching of gangue materials, beneficiation of the desired commodity and its agglomeration into a desired from, which may be, for example, balls, sinter, briquettes, pellets or other similarly configured products of a predetermined size. Illustrative of an operation utilizing a grinding mill is FIG. 1 which diagrammatically shows an exemplary grinding and balling process (Carol Pellet Co.). A grinding mill may utilize media, such as, for example, balls or rods, to grind the feedstock material to the desired size. However, autogenous mill 10 in FIG. 2 provides a rotary drum 12, which cascades raw material 14 upon itself to effect the grinding operation.

Drum 12 is generally cylindrical with feed end cover 16 at drum back end 18, and a similar cover 64 is provided at discharge end 20 but is broken away in this Figure for illustrative purposes. Feed chute 24 extends through rear port 22 within feed end cover 16 for any of continuous or intermittent transfer of raw material 14 into drum chamber 26. A similar port (not shown) is present in discharge cover 64 for trommel screen assembly 28, which receives ground material from drum 12 through means of a plurality of discharge chutes or veins 30. The trommel screen assembly is merely an illustrative screen means and not a limitation as these grinding operations may transfer their products to conveyors, to storage, to screen operations or other desired operations. In this illustration, assembly 28 is generally an elongate cylinder and has trommel screens 32 arranged about its circumference. As drum 12 and assembly 28 rotate, the material transferred to enclosure 34 of assembly 28 is screened or sifted to separate the fines through means of screens 32 for transfer to subsequent operations and the coarser sized materials are communicated to return troughs or buckets 36 for deposit within stationary oversize return box 38. The oversize materials are returned to drum chamber 26 through means of tapered return tube 40 extending through opening 42 for further grinding of the oversize materials to an acceptable size.

As the discharge chute structures 30 are similarly constructed only one will be described and it is understood that the description is applicable to the several chutes. Discharge chutes 30 provide an initial sizing function as they capture only materials below a predetermined size in their grate charger segment 44 at drum sidewall 46 for transfer to screen assembly 28. Discharge chutes 30 have an inner tube 31 in FIG. 2 providing a shaft 33 for urethane inserts, which help to abate internal erosion of tubes 31. Discharge chute 30 in FIG. 3 has grate discharger segment 44 provided with apertures 48, for capture of ground raw material. Insert 50 within chute 30 is shaped to provide a cavity 52 for the raw material and is open at its upper end 54 as seen in the figure. Intermediate segments 56 and 58 are shown as comprising generally rectangular sections with through passages 60 and 62, respectively. Each of these segments 50, 56 and 58 are inserted within shaft 33 and are attached to the end wall or discharge head or cover 64.

Figure 3:
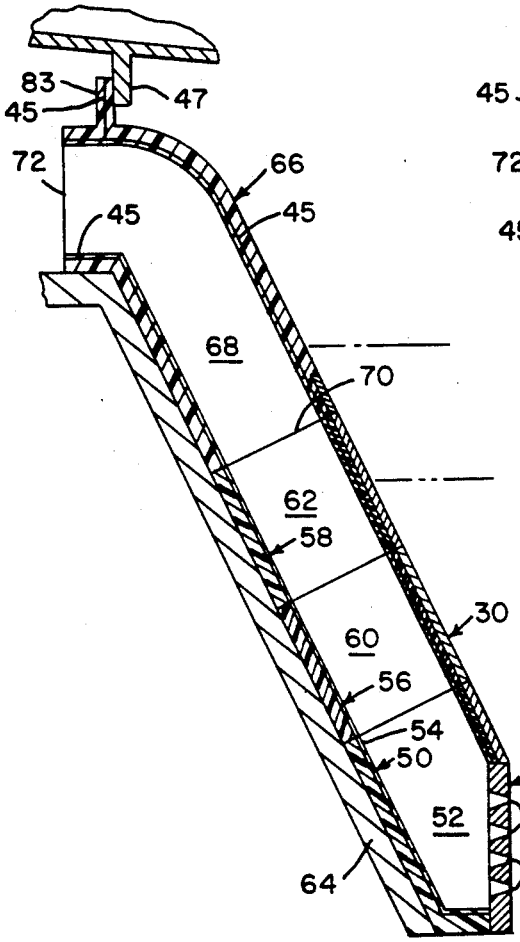
FIG. 3 is a cross-sectional elevational view of a discharge chute used within the grinding mill of FIG. 2.

Discharge cone 66 with passage 68 and opposite end openings 70 and 72 is also generally rectangular in this figure but is arced at its upper end so as to fit within the discharge port and communicate to enclosure 34 of assembly 28. As shown in FIG. 3, each of segments 50, 56, 58 and 66, as well as their respective passages are alignable so as to communicate the captured raw material within cavity 52 to assembly 28 for screening. As drum 12 and discharge chutes 30 rotate the relative elevation of the discharge grates 44 changes for gravity discharge of the raw material through the aligned passages of each of the segments of the chute and cone opening 72. Segments 50, 56, 58 and 66 are urethane-coated components, which are formed upon a skeletal-like shell of stiff material 45, such as, for example, steel plate, which is more clearly noted in FIGS. 4 and 5. Although the illustrated and preferred coating is a urethane composition, it is also contemplated that alternative coatings may be utilized such as, for example, rubber, which is molded or formed upon a shell.

Figure 4:
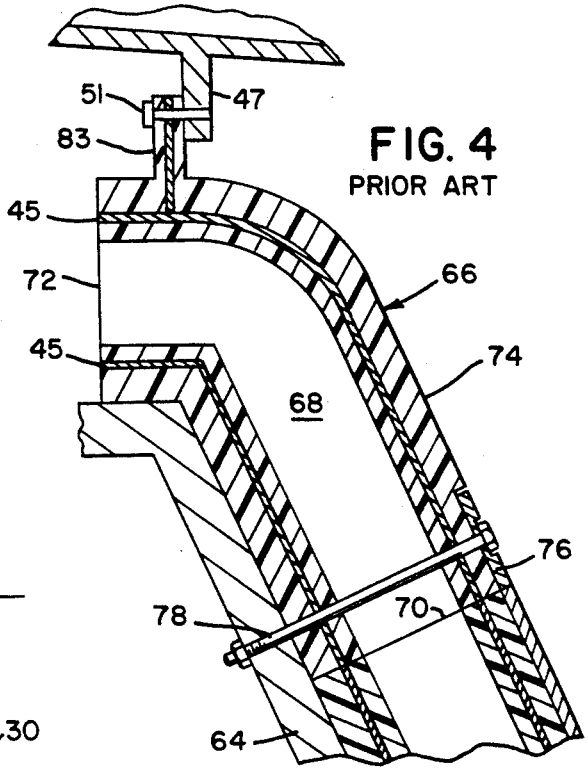
FIG. 4 PRIOR ART
FIG. 4 is a cross-sectional elevational view of a prior art discharge cone structure with a replacement plate.

Previous discharge cones 66, as noted in FIG. 4, were a single coating material design as they were not exposed to an external high-wear condition, which would cause premature wear and replacement. However, as mill operators changed the operating parameters so as to increase productivity or efficiency the changed conditions negatively impacted upon cones 66. More specifically the level of the raw material within drum chamber 26 was increased and provided the bed/air interface 17 at the outer surface 74 of cone 66. The aggressive and abrasive attack of the tripartite environment of air, moisture and solids within chamber 26 led to the erosion of the single urethane material cone structure and the subsequent earlier-than-desired replacement requirement. Initial attempts to overcome the rapid wear and replacement problem merely resulted in placing a metal wear plate 76 at the interface region upon outer surface 74, which prolonged the cone life for a period of time. The metal wear plate 76 was merely bolted to cone 66 and shell 64 by means of bolt 78, however, this assembly arrangement made it difficult to replace wear plate 76 since the same bolts 78 held the cone, which bolts became corroded and difficult to remove. Furthermore, cones 66 may each weigh up to 10,000 pounds and thus the magnitude of the mass of the objects becomes an imposing obstacle to the user and maintenance personnel.

Figure 5:
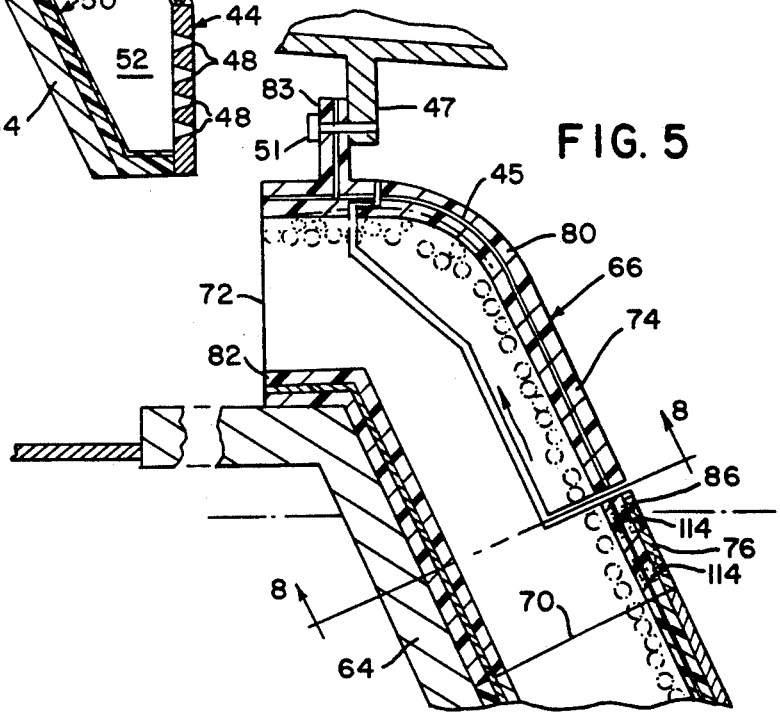
FIG. 5 is a cross-sectional elevational view of the discharge chute of the present invention.

In FIGS. 5–8, a preferred embodiment of cone 66 comprises a three material assembly arranged to provide the basic functional cone structure while also being arranged to overcome the abusive environment so as to prolong the cone life cycle, thus requiring fewer replacements and making actual replacement easier. As noted above the cone has to endure abrasion from the raw material, especially at the bed surface/air interface, as well as tolerating the hydration of the urethane from the moisture entrained within the raw material. The basic urethane utilization is maintained within cone structure 66, however, the highest wearing segment 80 of cone 66, which is illustrated as the furthest component from shell wall 64 with a hood-like appearance in FIG. 5, is a tough, long wearing polyurethane composition, such as, for example, Irathane System Incorporated material 3040. The outer wall segment 82, as considered in connection with or relative to drum chamber 26, which is in proximity or contacts shell wall 64, is a lower wearing segment, although still a long-wearing material, having greater hydrolytic stability and is therefore more tolerant of long exposure to moisture-laden environments. The improved hydrolytic stability provides for an extended life for segment 82 within the moisture-laden environment, which provides a segment that is expected to survive through the replacement of two of the highest-wearing components 80 and to thereafter be rebuilt with a new hydrolytically stable coating such as, for example, Irathane System Incorporated material 2855. Higher wear segment 80 at its opening end 70 has a notch 86 cut or formed therein for receiving a metal plate 76, and bolt passages 88, 90, 92 and 94 are formed within inner segment 80 so as to affix plate 76 for ease of assembly and replacement. Similarly highest wearing segment 80 is secured to segment 82 by means of bolts 96 extending through inner or highest wear segment 80, and mated with nuts installed within lower wear portion 82 of cone 66. Bolts 96 may extend through rib 108 of the cone section as seen in FIG. 8, which has two discharge shafts 33, although bolt 96 is not specifically illustrated. In addition, overlapping edges 100 of outer segment 82 and inner segment 80 each have flanges 99 as seen in FIG. 6 for self-tapping screws 98, which are utilized to secure inner segment 80 to outer segment 82 at overlapping edges 100 noted in FIG. 8. The overlapped edges 100 include mating shoulders to positively locate the inner and outer (or lower wear) segments 80, 82. A centrally located and vertically extending rib 102 of inner segment 80 has a slot 104 so as to mate with protuberance 106 of outer segment vertical rib 108 so as to positively locate the inner and outer segments and the bolts 96. A flange 83 in FIGS. 3–5 extends radially inwardly from inner segment 80 at the discharge port and is operable to be coupled with a juxtaposed flange 47 of tube 40 so as to secure the tube 40, drum 12 and chutes 30 for synchronous rotation. The flanges 83 and 47 are joined by means of a bolt 51 in the Figures for illustration only, however they may be joined by any means known in the art.

The arrangement of the discharge chutes 30 illustrated in FIG. 9 shows a plurality of shafts 33 converging at or feeding a single cone 66, which is a possible arrangement but not a limitation. The radially extending cones 66 are arranged to form a discharge portal 67 for the transfer of material to the screen assembly 28 by means of the rotation of drum 12, but alternative screen assemblies 28 may not require a return tube 40 and may instead place a cap or flange at this portal. Other operational structures may merely discharge the produces through means of portal 67. The internal movement of the ground ore is along the inner segment of passage 68 as shown in FIG. 5, although it is appreciated that this illustration is inverted as the ore path is defined from grate 44 to cone 66. As the rotation of the drum is continuous cone 66 is both internally and externally abraded by means of the raw material. The highest wear material segment 80 is anticipated to be operable for approximately an 8 million ton throughput of material before being discarded, and the lower wear segment 82 is anticipated to survive a 16 million ton throughput before being removed and rebuilt for another cycle. However, it is expected that metal plate 76 will be replaced at approximately 4 million tons of throughput, and thus the replacement of plate 76 is a primary concern for this assembly.

Wear plate 76 is secured within notch 86 by means of at least two bolt studs 114 and nuts 110, as shown in FIGS. 6 and 7. Recesses 113 and 115 are provided within inner wear segment 80 so as to accommodate an anchoring nut 117 and the stud head 119, respectively. Replacement of plate 76 is accomplished by removal of nut 110 in FIG. 7 within the mill, such as, for example, by cutting the same with a torch and the removal of plate 76. Replacement plate 76 is inserted within notch 86 of segment 80 and anchored in position by removal of hand-hold plugs 112 from hand inlets 81 of high wear segment 80 for insertion of threaded studs 114 within the bolt passages 88–94 and the securing thereof by means of nuts 110 upon new plate 76. Thus, replacement of discharge cone 66 in toto is only required after approximately 16 million tons of throughput instead of the present requirement of replacement at approximately 8 million tons. Present discharge cone assemblies require arduous maintenance both inside and outside drum 12 to replace wear plate 76, which requirement is overcome by means of the present assembly, which only requires a single worker inside drum 12 to burn four nuts from studs 114 for reinstallation of a plate 76 with a amount of lost time. In addition, inner segment 80 is easily removable for its replacement and repair of cone 66 without removal of the entire cone 66. Bolts 96, or the nuts securing these bolts, are cut, and the self-tapping screws are removed, thus freeing segment 80 for removal, repair or replacement.

Although cone 66 has been illustrated as an arc segment in FIGS. 6 and 9, it is noted that the cone may be formed as a continuous annulus with discharge portal 67. The annular ring 75, as illustrated in FIG. 2, is mountable within the discharge port and the discharge chutes 30 are coupled to the ring's outer periphery for transferring the ore through tube 33 and cone 66.

The above discussion has noted the preferred embodiment of cone 66 incorporating wear plate 76, but it is considered that discharge cone 66 may be a two-piece assembly as shown in FIG. 5 without wear plate 76 and notch 86 so as to provide a continuous sidewall to cone inner surface 74 upon inner section 80 down to opening 70. This structure would provide ease of replacement of heavier wearing segment 80 for those applications where a metal wear plate 76 is not required either from structural or production operational requirements.

While only specific embodiments of the invention have been described and shown, it is apparent that various alterations and modifications can be made therein. It is, therefore, the intention in the appended claims to cover all such modifications and alterations as may fall within the scope and spirit of the invention as defined by means of the appended claims.

What is claimed is:

1. In a mill for grinding ores having a housing with a chamber for containment of said ores during grinding, a discharge port, a feed port, and a plurality of discharge devices, each one of said discharge devices having at least one discharge cone, and a grate charger segment defining a first passage with a first end and a second end, and a plurality of apertures defined within one of said first and second ends of said grate passage for communication between said chamber and said first passage, wherein said first passage is open at the other one of said first and second ends, said at least one discharge cone comprising:

a first inner section, and a second outer section connected with said first section so as to define said discharge cone;

said first inner and second outer sections defining a cone conduit having an inner surface, an outer surface, a cone first end, and a cone second end, said cone conduit defining a second passage therein which is open at said one first and second ends, one of said cone first and second ends being coupled to said grate charger segment at said other one of said grate first and second ends, the other one of said cone first and second ends communicating between said discharge port and said second passage of said cone conduit;

said cone conduit outer surface having a notch defined upon a portion of said outer surface which is normally exposed to said ores disposed within said housing chamber, and at least one through-bore communicating between said cone outer surface and said cone second passage;

a metal plate with at least one aperture alignable with said at least one through-bore and positionable within said notch; and securing means extending only through each of said aligned metal plate aperture and said cone conduit through-bore for anchoring said plate within said notch so as to protect said discharge cone from abrasive wear by means of said material disposed within said chamber during rotation of said housing so as to extend the longevity of said discharge cone and provide ease of replacement of said metal plate within said notch of said discharge cone.

2. A mill as claimed in claim 1 wherein said inner and outer cone section have a frame, said inner section frame having a first and hard-wearing coating on said inner and outer surfaces, and said outer section having a wear-resistant coating upon said inner and outer surfaces of a second material, and said metal plate provides a repairable component on said cone.

3. A mill as claimed in claim 2 wherein said second outer section wear-resistant coating is a first urethane composition, which first urethane composition is hydrolytically stable.

4. A mill as claimed in claim 3 wherein said first section hard-wearing coating is a second urethane composition.

5. A mill as claimed in claim 1 wherein said inner and outer cone sections, each have a rigid frame element interposed between said inner and outer surfaces with an abrasion-resistant coating comprising each of said inner and outer surfaces.

6. A mill as claimed in claim 5 wherein said abrasion-resistant coating is at least one rubber composition.

7. A mill as claimed in claim 5 wherein said abrasion-resistant coating on said outer section is a first rubber composition and said abrasion-resistant coating on said inner section is a second rubber composition which has a higher abrasion resistance than said first rubber composition.

8. A mill as claimed in claim 5 wherein said abrasion-resistant coating is at least one urethane composition.

9. A mill as claimed in claim 5 wherein said abrasion-resistant coating on said outer section is a first urethane composition which is hydrolytically stable and said abrasion-resistant coating on said inner section is a second urethane composition with a higher abrasion resistance than said first urethane composition.

10. A mill as claimed in claim 1 wherein said housing comprises a drum having a feed end with an end cover having a feed opening; a discharge end with a discharge end cover having a discharge portal;

said plurality of mill other ends being positioned at said discharge portal for discharging ground ores from said chamber.

11. A mill as claimed in claim 10 further comprising separating apparatus disposed adjacent to said chamber, said separating apparatus having a return tube;

said cone other ends cooperating to define a port at said discharge portal;

said return tube positionable in said port and securable to said cones for movement with said cones and for returning separated material from said separating apparatus to said drum chamber.

12. Discharge apparatus for an autogenous grinding mill for generally granular material, comprising:

a shaft with one of first and second ends being sealed and having a plurality of apertures extending through said sealed end;

said shaft comprising a lower segment and at least one intermediate segment, each of said segments having a passage with a first end and a second end wherein said passages are alignable for communication through said passages and said shaft;

a discharge cone comprising an outer section and an inner section, each of said sections having an outer surface and an inner surface, wherein said cone has a notch defined upon said outer surface of said inner section and at least one through-bore extending through said inner section;

a metal plate having at least one aperture; and securing means extending only through said at least one aperture of said metal plate and said at least one through-bore of said inner section of said discharge cone for anchoring said plate within said notch so as to provide a wear surface for inhibiting abrasive wear upon said discharge cone and for extending the longevity of said discharge cone from intermittent and frictional contact with said granular material.

13. A discharge apparatus as claimed in claim 12 wherein each of said inner and outer sections comprises an inner, rigid frame member and wherein said inner and outer surfaces each comprise a wear-resistant coating, said discharge cone inner section comprising a high-wearing portion comprising a first urethane coating, and a second, lower wearing portion on said cone outer section, with said second and, lower wearing urethane coating surface being a hydrolytically stable urethane material.

14. A discharge apparatus as claimed in claim 13 wherein said mill lower-wearing section is rebuildable.

15. A discharge apparatus as claimed in claim 12 wherein said metal plate is secured to said cone inner surface for ease of removal.

16. A discharge apparatus as claimed in claim 12, further comprising a plurality of discharge cones, each of said cones comprising an arc segment, said cone arc segments mountable in a discharge port and alignable so as to form an annulus comprising a discharge portal.

17. Discharge apparatus as claimed in claim 16, wherein:

said annulus defines at least a first end and a second end, one of said ends being connected to remaining portions of said discharge apparatus other than said discharge cones, the other one of said discharge cone first and second ends being open at said discharge port so as to provide communication between said remaining portions of said discharge apparatus and said discharge port so as to discharge said ore.

18. In a mill for grinding ores, comprising a housing defining a chamber for containment of said ores during grinding, a discharge port, a feed port, and a plurality of discharge devices, each one of said discharge devices having at least one discharge cone and a rate charger segment defining a first passage with a first end and a second end and a plurality of apertures defined within one of said first and second ends of said grate passage for communication between said chamber and said first passage of said grate charger segment, wherein said first passage of said grate charger segment is open at the other one of said first and second ends, said at least one discharge cone comprising:

a cone conduit having an inner surface, an outer surface, a cone first end and a cone second end, said cone conduit defining a second passage therein, for the flow of ground ores therethrough from said first passage of said grate charger segment to said discharge port and along said inner surface of said cone conduit, which is open at said cone first and second ends, one of said cone first and second ends being coupled to said grate charger segment at said other one of said grate first and second ends, the other one of said cone first and second ends providing communication between said discharge port and said second passage of said cone conduit;

said cone conduit further comprising a first inner section disposed in abrasive contact with said ores disposed within said chamber, and a second outer section, separate and distinct from said first inner section, secured to said housing and disposed out of contact with said ores disposed within said chamber;

means defined upon said second outer section of said cone conduit for rendering said second outer section of said conduit matable with said first inner section of said cone conduit; and means for securing sad first inner section of said cone conduit to said second outer section of said cone conduit in a removable manner so as to define said cone conduit and yet provide ease of replacement of only said first inner section of said cone conduit with respect to said second outer section of said cone conduit as said first inner section of said cone conduit is abrasively worn by means of said ores disposed and ground within said chamber.

19. A mill as set forth in claim 18, wherein:

said means for rendering said first and second sections matable with each other comprises a plurality of interengaged rib means.

20. A mill as set forth in claim 19, wherein:

said securing means comprises a plurality of bolts extending through said rib means.

* * * * *